United States Patent [19]

Sutton

[11] Patent Number: 4,754,844

[45] Date of Patent: Jul. 5, 1988

[54] ERECTABLE SAWHORSE

[76] Inventor: Johnny W. Sutton, 3617 Mt. Everest Blvd., San Diego, Calif. 92111

[21] Appl. No.: 59,587

[22] Filed: Jun. 8, 1987

[51] Int. Cl.[4] ..... B27B 21/00

[52] U.S. Cl. ..... 182/155; 182/225

[58] Field of Search ..... 182/155, 151, 181–185, 182/225, 224

[56] References Cited

U.S. PATENT DOCUMENTS

| | | | |
|---|---|---|---|
| 1,823,871 | 9/1931 | Beasley | 182/155 |
| 2,755,144 | 7/1956 | Simmons | 182/155 |
| 4,508,194 | 4/1985 | Freewalt | 182/153 |

*Primary Examiner*—Reinaldo P. Machado

*Attorney, Agent, or Firm*—Brown, Martin, Haller & Meador

[57] ABSTRACT

An erectable sawhorse including a frame and a pair of leg assemblies moveably attached to the frame, each of which can be pivoted between a collapsed position against an upper rail of the frame and an erected position away from the frame. When both legs are erected, the sawhorse can be placed upright on a supporting surface and used. Each leg is pivotally attached to the frame by a mechanism which permits the leg to be first pivoted between the upper rail and the end of the frame and second pivoted about the frame end to the erected position. A guide track attached between the upper rail and the frame end acts between the frame and the leg assembly by guiding the leg assembly through its first and second pivots.

20 Claims, 2 Drawing Sheets

ERECTABLE SAWHORSE

BACKGROUND OF THE INVENTION

The invention concerns a sawhorse or other work support apparatus which can be placed in two configurations: a working configuration in which two leg assemblies are erected to support the sawhorse in a working position and a compact, transportable configuration in which the leg assemblies are pivoted to a collapsed position.

A sawhorse is a conventional work support apparatus which includes an elongate upper rail for supporting work pieces and a pair of wedge-shaped leg assemblies attached to either end of the upper rail. When not in use, such conventional sawhorses are typically stored and moved in stacked configurations in which one sawhorse is placed atop another, with the upper rail of the bottom sawhorse fitting into the apices of the top sawhorse's leg assemblies. This makes for inefficient storage and awkard handling of unused sawhorses.

A desirable feature of a sawhorse would be an ability to reconfigure it into a compact position when the horse is stored or moved. This has been a difficult feature to realize, since the sawhorse, by its very nature, must provide a rugged stability when erected for use. Any collapsible or compacting feature of a sawhorse must not detract from its ability to withstand long, hard usage.

SUMMARY OF THE INVENTION

The inventor has satisfied the long-felt need for a sawhorse which can be placed in a compact form for storage and transport through the provision of a pair of leg assemblies pivotally attached to each end of the horse and guided between collapsed positions adjacent the main frame of the horse and erected positions at each end of the horse by a guide track which is integrated into the structure of the sawhorse.

In this regard, the invention is expressed as an erectable work support apparatus that includes a frame with opposing frame ends and an upper rail extending between the ends. Attachment locations are defined on each of the frame ends, and leg assemblies are attached to the frame ends at the attachment locations. Each leg assembly is attached to a respective location by an attachment mechanism which connects the leg assembly to the frame end at the attachment location and which permits the leg assembly to be pivoted on the frame about the attachment location. A guide track acts between the frame and the leg assembly for guiding the leg assembly on a pivoting path between a first collapsed position adjacent the upper rail and an erected, ground-engaging position.

The invention also finds embodiment as an erectable mechanism for supporting a work assembly or the like and, in this aspect, includes a leg assembly, a member, stationary with respect to the leg assembly and an attachment location on the member. An attachment mechanism connects the leg assembly to the member at the attachment location and permits the leg assembly to be pivoted on the member with respect to the attachment location. A guide mechanism acts between the member and the leg assembly by guiding the leg assembly on a pivoting path between a collapsed position in which the leg assembly has a first folded orientation with respect to the member and an erected position in which the leg assembly has a second orientation pivoted from the first orientation.

Finally, the invention concerns an erectable sawhorse that has a frame with opposing frame ends and an upper rail extending between the frame ends. An attachment location is identified on each of the frame ends. The sawhorse includes a pair of leg assemblies, each attached by a respective attachment mechanism to a respective attachment location. Each of the attachment mechanisms includes an attachment means which moveably connects a leg assembly to an attachment location such that the leg assembly can be pivoted in at least two directions at the respective attachment location and a guide assembly acting between the frame and the leg assembly for guiding the leg assembly on a first pivoting path between the upper rail and the frame end to which the leg assembly is attached and further for guiding the leg assembly on a second pivoting path having an axis which is substantially colinear with the frame end.

In all of its aspects, the invention is based upon an attachment mechanism which includes an annular collar rotatably mounted on a frame end or member at an attachment location and a trunnion radially fixed to the collar. The leg assembly is pivotally attached to the trunnion. The guide assembly includes an elongate track to which the leg assembly is slidably attached. The elongate track has a first arcuate section extending between the upper rail and the frame end and a second arcuate section which is substantially perpendicular to the first arcuate section and which terminates on the frame end. The combination of the attachment mechanism and the guide track permit a leg assembly to be reliably and repeatably moved between a collapsed or compact position and an erected position. A finger screw is provided for attaching the leg assembly to the frame end when erected. This provides three attachment points—the attachment mechanism, the second arcuate section of the guide track, and the thumb screw—for maintaining a leg assembly in an erected position, which results in the stability and ruggedness required for long term use of the sawhorse.

The primary objective of the invention is therefore to provide an erectable sawhorse or work support apparatus which can be collapsed or compressed into a configuration appropriate for efficient transport or storage and erected into a configuration appropriate for use under rugged work conditions.

This object and other intended objects and advantages will become more evident when the following detailed description of the invention is read while giving reference to the drawings, in which.

DETAILED DESCRIPTION OF THE PREFERRED EMBODIMENT

Figure 1:
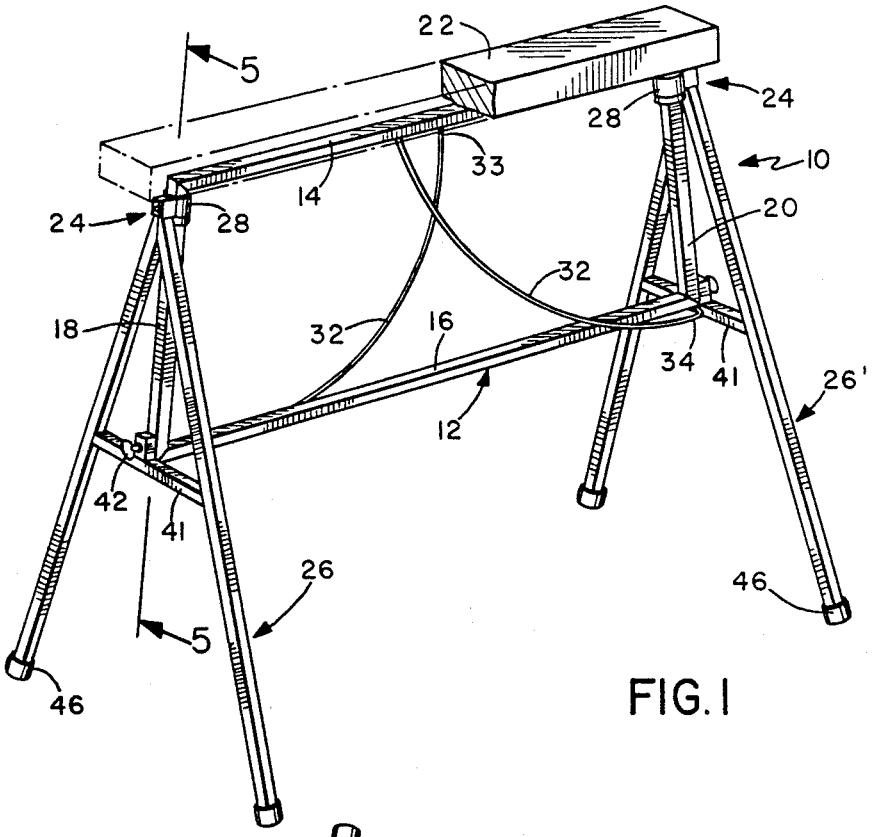
FIG. 1 is a perspective view of the sawhorse of the invention in its erected configuration.
Figure 2:
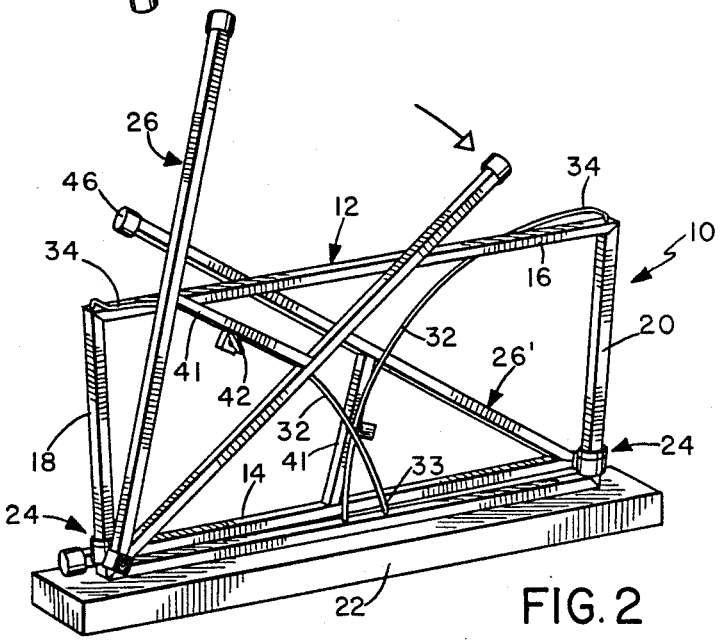
FIG. 2 is a perspective view of the sawhorse in its collapsed or compacted configuration and rotated about its upper rail by 180 degrees from FIG. 1.
Figure 5:
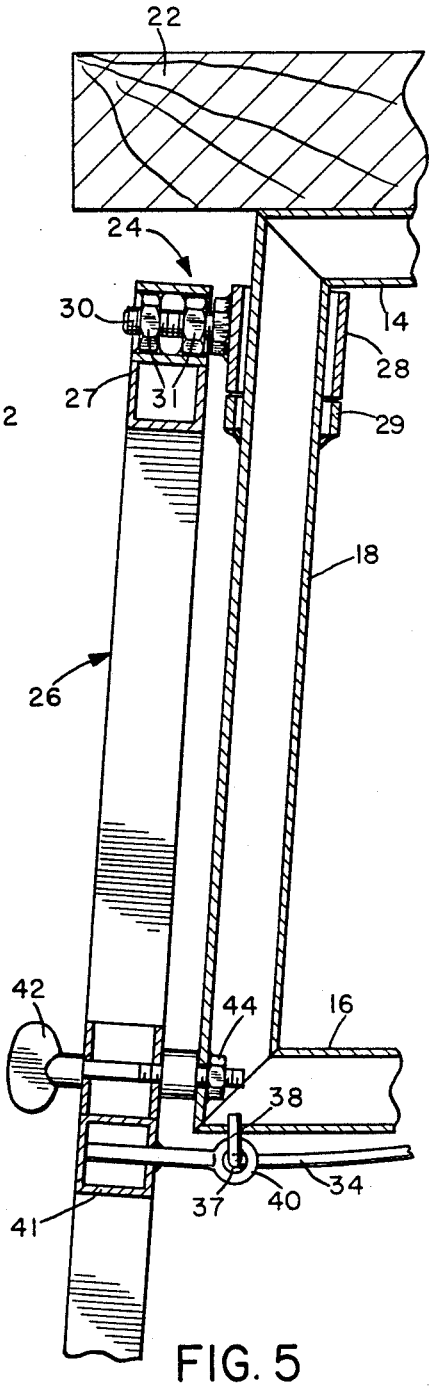
FIG. 5 is an enlarged cross-section taken along 5—5 of FIG. 1.

The invention is illustrated in its erected configuration in FIGS. 1 and 5 and in its collapsed configuration in FIG. 2. The invention is an erectable sawhorse indicated generally by 10 which includes a frame assembly 12. The frame assembly includes an upper frame rail 14, a lower frame rail 16 and a pair of side rails connecting the upper and lower rails and forming the frame ends 18 and 20. A top rail 22 is attached to the upper frame rail 14 for supporting work pieces when the sawhorse 10 is erected.

The following description is given in connection with the frame end 18 and concerns a leg assembly, attachment mechanism, and guide mechanism, all of which operate with reference to the frame end 18. It is understood that the structure to be described is symmetrical with corresponding structure on the other end of the sawhorse at the frame end 20. An attachment location, indicated generally by 24, is defined where the side rail forming the frame end 18 joins the upper rail 14. A leg assembly 26 is attached to the frame end at the attachment location 24, the connection between the frame end 18 and the leg assembly 26 being made at the apex 27 of the leg assembly 26. An identical leg assembly 26' has an identical apex and is connected to the frame end 20 at an attachment location corresponding to the attachment location 24, the attachment being as described below with reference to the leg assembly 26.

Figure 3:
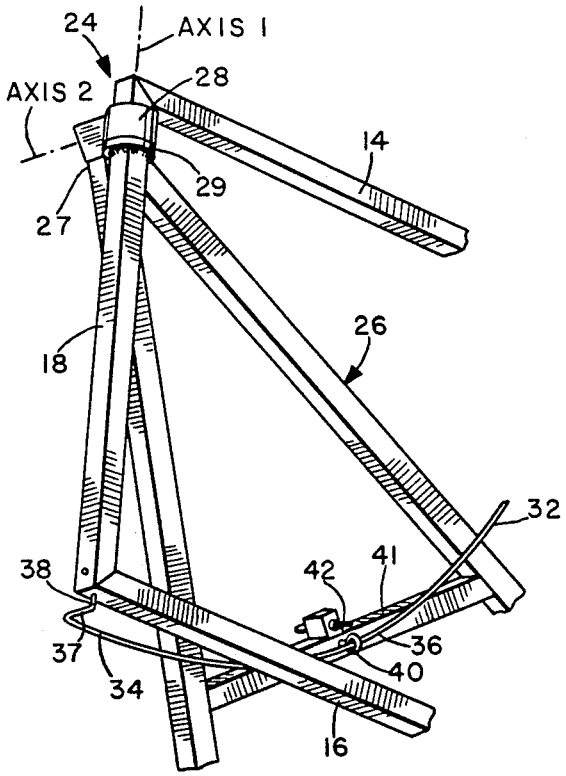
FIG. 3 is an enlarged perspective view showing the attachment mechanism.

Refer now to FIGS. 1, 3, and 5. The leg assembly 26 is attached to the frame end 18 at the attachment location 24 by an attachment mechanism including an annular collar 28 (which will also be referred to hereinafter as a swivel), a swivel retainer 29, and a threaded trunnion 30. The collar 28 is retained in a circumferentially unrestrained, rotating engagement with the frame end 18 between the swivel retainer 29 and one end of the upper frame rail 14. The swivel retainer 29 is preferably an annular collar having a diameter equal to the diameter of the swivel 28 and fixedly welded to the side rail forming the frame end 18. Thus retained, the swivel 28 is free to turn through at least 90 degrees in either direction on the frame end 18 at the attachment location 24. As shown in FIG. 3, the apex 27 is drilled to accept the trunnion 30. The leg assembly 26 is retained on the trunnion by a double nut assembly 31, contained in the apex 27 of the leg assembly. The double nut assembly includes a pair of nuts separated by a spacer and retained in a drilled enclosure in the apex 27. It should be appreciated with reference to FIG. 3 that the leg assembly 26 can be pivoted with respect to the frame end 18 and at the attachment location 24 either on the trunnion 30 or by rotation of the collar 28.

Figure 4:
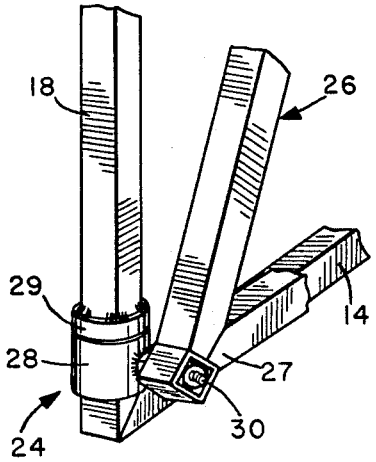
FIG. 4 is an enlarged perspective view showing the guide track and the operation of the leg assembly.

Referring now to FIGS. 1, 2, and 5, the guide mechanism of the invention includes a guide track 32 which is an elongated rod having ends 33 and 34. As shown in FIGS. 1, 2, and 4, the rod forming the guide track 32 has a first arcuate section 36 which defines substantially a quarter of a circle centered at the attachment location 24. Near the end 34, the guide track transitions to a second arcuate section 37 which describes a portion of a circle smaller in diameter than the circle described by the arcuate section 36. As seen in FIG. 4, the second arcuate section 37 is oriented transversely and substantially perpendicularly to the arcuate section 36 and to the circle described thereby. Further, the second arcuate section 37 spirally transitions down to extension 38 by which the guide track 32 is attached to the frame end 18 to be colinear therewith. FIG. 4 further shows an eye 40 attached at one end to a cross piece 41 attached between the legs of the leg assembly 26 and encircling the guide track 32. The eye 40 forces the leg assembly 26 to follow a series of two pivoting legs described by the guide track 32.

To provide a description of the operation of the invention, it is assumed that the sawhorse is initially in the closed or collapsed configuration illustrated in FIG. 2 wherein both of the leg assemblies are folded down to lie in a collapsed position adjacent the upper rail 14. Referring now to FIGS. 2 and 4, an operation for erecting the leg assembly 26 to an erected position will be described with the understanding that the description applies as well to the leg assembly 26'. The end result of the described operation will be to place the sawhorse into the configuration illustrated in FIG. 1, which may be described as an open, erected, or working configuration. Referring now to FIGS. 2 and 4, the leg assembly 26 is initially in a closed or collapsed position lying along the upper rail 14. To erect the leg assembly 26, the leg assembly is pivoted on the trunnion 30, with the pivoting taking place about the axis labeled AXIS 2 in the Figure. As shown, AXIS 2 passes through the attachment location 24. When pivoted on the trunnion 30, the leg assembly 26 is guided by the first arcuate section of the guide track 32 through the quarter circle described by the first arcuate section. As the pivoting continues, the eye 40 moves onto the second arcuate section 37 of the guide track 32, causing the leg assembly 26 to pivot in a different direction. The second pivoting direction is determined by rotation of the swivel 28 about the axis labeled AXIS 1 in the Figure. As seen, AXIS 1 is essentially colinear with the frame end 18. The leg assembly 26 continues to pivot through the action of the collar 28 until the eye 40 reaches the point where the second arcuate section 37 transitions to the end section 38. At this point, the second pivoting motion is stopped and the leg assembly 26 is in its erected position where it is retained by a thumb screw 42 (illustrated FIGS. 1, 2, and 5). The thumb screw 42 is inserted through an opening in the nail 18 and threaded into a threaded nut 44 welded inside one end of the rail 18. The thumb screw 42 is then tightened. Thus erected, the leg assembly 26 is retained in its erected position at the attachment point 24 by the double nut assembly 31, by the engagement of the eye 40 with the second arcuate section 37, and by the threaded engagement of the thumb screw 42 with the threaded nut 44. It is understood that this sequence of operations for erection of the leg assembly described as well the sequence of operations for erecting the leg assembly 26'. With both leg assemblies erected, the sawhorse thus is placed in the configuration illustrated in FIG. 1, and is ready for use. Further, the leg assemblies 26 and 26' are placed in their closed or collapsed positions by reversing the erecting operation just described.

One will appreciate that the essential concept of the invention, the combination of the leg, the attachment mechanism, and the guide track as applied to a work surface can be used alone to support, for example, a work surface which is hinged at one end to an attachment member or surface. Thus, for example, it is contemplated that the upper frame rail 14 or top supporting rail 22 might be hinged at one end to a wall or supporting member and be pivotable between an upright, stowed position and a lowered, working position. In such an adaption, it is contemplated that a single leg assembly corresponding to the leg assembly 26 would be attached to the rail in the manner taught hereinabove to be positionable between a closed and an erected position as taught herein.

It will be evident that many modifications and variations of my invention will occur to those skilled in the art and that such modifications and variations can be practiced without departing from the spirit of the invention described and claimed.

I claim:

1. An erectable work support apparatus, comprising:
a frame with at least one frame end and an upper rail;
an attachment location on said frame end;
a leg assembly;
attachment means for connecting said leg assembly to said frame at said attachment location and for permitting said leg assembly to be pivoted in two separate planes on said frame with respect to said attachment location; and
stationary guide means acting between said frame and said leg assembly for guiding said leg assembly on a pivoting path between a first collapsed position adjacent said upper rail and an erected, ground engaging position.

2. The work support apparatus of claim 1 wherein said attachment means includes an annular collar rotatably mounted on said frame end at said attachment location.

3. The work support apparatus of claim 2 wherein said attachment means further includes a trunnion mounted radially on said collar, and means for rotatably attaching said leg assembly to said trunnion.

4. The work support apparatus of claim 1 wherein said guide means includes an elongate member having a first arcuate section describing substantially a quarter first circle parallel to said frame and centered adajcent said attachment location.

5. The work support apparatus of claim 4 wherein said arcuate member has two ends, the first of said ends being attached to said frame adjacent said upper rail, the second of said ends being attached to said frame end.

6. The work support apparatus of claim 5 wherein said second end includes a second arcuate section describing a portion of a second circle transverse to and having a smaller diameter than said first circle.

7. The work support apparatus of claim 1 wherein said leg assembly includes an A-shaped structure having an apex moveably connected to said attachment means.

8. An erectable mechanism for supporting a work assembly or the like, comprising:
a leg assembly;
a member, stationary with respect to said leg assembly and including an attachment location;
an attachment means for connecting said leg assembly to said member at said attachment location and for permitting said leg assembly to be pivoted in two separate planes on said member with respect to said attachment location; and
stationary guide means acting between said member and said leg assembly for guiding said leg assembly on a biaxial pivoting path between a first collapsed position in which said leg assembly has a first, folded position with respect to said member and an erected position pivoted from said first position.

9. The mechanism of claim 8 wherein said attachment means includes an annular collar rotatably mounted on said member at said attachment location.

10. The mechanism of claim 9 wherein said attachment means further includes a trunnion mounted radially on said collar and means for rotatably attaching said leg assembly to said trunnion.

11. The mechanism of claim 8 wherein said guide means includes an elongate member having a first arcuate section describing substantially a quarter of a first circle centered substantially at said attachment location.

12. The mechanism of claim 11 wherein said elongate member is connected at one end to said member and transitions to a second arcuate section at said one end, said second arcuate section describing a circle transverse to and having a smaller diameter than said first circle.

13. The mechanism of claim 8 wherein said leg assembly included an A-shaped structure having an apex moveably connected to said attachment means.

14. An erectable sawhorse, comprising:
a frame with opposing frame ends and an upper rail extending between said ends;
an attachment location on each of said frame ends;
a pair of leg assemblies; and
a pair of attachment mechanisms, each for connecting a respective leg assembly to a respective attachment location, each said attachment mechanism including:
an attachment means for moveably connecting a leg assembly to an attachment location such that the leg assembly can be pivoted in at least two directions at the leg assembly's attachment location; and
a guide means acting between said frame and a leg assembly for guiding the leg assembly on a first pivoting path between said upper rail and the frame end to which the leg assembly is connected and further for guiding the leg assembly on a second pivoting path around said frame end.

15. The sawhorse of claim 14 wherein said attachment means includes an annular collar rotatably mounted on said frame end at said attachment location.

16. The sawhorse of claim 15 wherein said attachment means further includes a trunnion mounted radially on said collar and means for rotatably attaching said leg assembly to said trunnion.

17. The sawhorse of claim 14 wherein said guide means includes an elongate member having a first arcuate section describing substantially a quarter of a first circle having an axis which is substantially perpendicular to said frame end and having a second arcuate section continuous with said first arcuate section and describing a second circle with an axis different than the axis of said first circle.

18. The sawhorse of claim 17 including means slidably connecting the leg assembly to said elongate member.

19. The sawhorse of claim 17 including means for locking the leg assembly to said frame end in an erected position.

20. The sawhorse of claim 14 wherein said guide means includes an elongate member having a first arcuate section describing substantially a quarter of a first circle and having an axis which is substantially perpendicular to said frame end having a second arcuate section continuous with said first arcuate section and describing a second circle with an axis perpendicular to the axis of said first circle.

* * * * *